US005402610A

United States Patent [19]

Salva' et al.

[11] Patent Number: 5,402,610

[45] Date of Patent: Apr. 4, 1995

[54] STANDARDIZED STEP MODULE FOR BUILDING PREFABRICATED STAIRCASES, PROCESS FOR PRODUCING SUCH MODULE, PREFABRICATED STAIRCASE AND PROCESS FOR ASSEMBLYING PREFABRICATED STAIRCASES

[75] Inventors: Domenico Salva', Dossobuono; Massimo Mastella, Verona, both of Italy

[73] Assignee: Generali Costruzioni Srl abbr. GECO Srl, Italy

[21] Appl. No.: 859,910

[22] Filed: Mar. 30, 1992

[30] Foreign Application Priority Data

Mar. 29, 1991 [IT] Italy ..... VR91A0028
Aug. 14, 1991 [IT] Italy ..... VR91A0068

[51] Int. Cl.[6] ..... G04F 11/00

[52] U.S. Cl. ..... 52/182; 52/187; 52/188; 52/189

[58] Field of Search ..... 52/182–191, 52/741.2; 182/178, 194, 151; 249/14; 264/33, 34

[56] References Cited

U.S. PATENT DOCUMENTS

| | | | |
|---|---|---|---|
| 786,431 | 4/1905 | De Witt | 52/187 |
| 1,533,166 | 4/1925 | Daly | 52/741.2 |
| 2,281,698 | 5/1942 | Kogl | 249/14 |
| 2,593,683 | 4/1952 | Lyons | 182/194 |
| 3,055,146 | 9/1962 | Labato | 52/190 |
| 3,099,336 | 7/1963 | Hawkins | 182/178 |
| 3,196,997 | 7/1965 | Hager | 52/182 |
| 3,473,275 | 10/1969 | Lappin | 52/187 |
| 4,422,270 | 12/1983 | Lapointe et al. | 52/182 |
| 4,899,504 | 2/1990 | Hirschhorn | 52/182 |
| 5,014,475 | 5/1991 | Anderson, Jr. et al. | 52/182 |

FOREIGN PATENT DOCUMENTS

| | | | |
|---|---|---|---|
| 621794 | 6/1961 | Canada | 52/188 |
| 0332693 | 5/1903 | France | 52/190 |
| 761621 | 3/1934 | France . | |
| 1039212 | 9/1958 | Germany | 52/182 |
| 1042868 | 11/1958 | Germany . | |
| 531628 | 1/1973 | Switzerland . | |
| 0193260 | 2/1923 | United Kingdom | 52/182 |

*Primary Examiner*—Carl D. Friedman
*Assistant Examiner*—Wynn E. Wood
*Attorney, Agent, or Firm*—Evenson, McKeown, Edwards & Lenahan

[57] ABSTRACT

The standardized step module according to the present invention is provided with a pair of wings disposed aside of the step and having the shape, as seen in a side section, of a parallelogram whose bases are parallel to the tread of the step and are separated by a distance equal to the riser of the step. In the case of a step made of reinforced concrete, said wings are constituted by a metallic structure having said parallelogram shape and provided with suitable reinforcing members and buried in a casting of concrete. According to the invention, the metallic structure forming the step wing is provided with suitable coupling means for joining it to other adjacent modules, said means being generally constituted by through-holes into which are inserted, for instance, fixing bolts, and nuts. The conformation of the structure forming a wing of the module according to the invention allows a high production at a low cost of such reinforced concrete modules to be achieved.

24 Claims, 6 Drawing Sheets

STANDARDIZED STEP MODULE FOR BUILDING PREFABRICATED STAIRCASES, PROCESS FOR PRODUCING SUCH MODULE, PREFABRICATED STAIRCASE AND PROCESS FOR ASSEMBLYING PREFABRICATED STAIRCASES

The present invention relates to a standardized step module for building prefabricated staircases.

More particularly, the present invention relates to a monolithic step made of reinforced concrete or of metal, whose structure forms an easily producible standardized module which, when connected to other identical or similar modules, forms a staircase for any kind of building.

The invention also relates to a process for producing such a module.

Furthermore, the invention relates to a prefabricated staircase having a rectilinear or a helical development formed by a plurality of monolithic steps made of any material (reinforced concrete with risers and/or treads made of marble, stone, granite or plate, wood etc.) and having a metallic supporting structure suitable for forming flights, whereby the staircase may comprise intermediate or main landings.

Finally, the invention refers to a process for assemblying a prefabricated staircase.

The invention may be mainly applied in the field of industrialized building technique.

BACKGROUND ART

The use of prefabricated staircases in building technique is widely known.

By way of example, a known staircase is provided with single step elements each having a pair of supporting wings, a riser and a tread, said step elements being able to be joined with other similar elements in order to form a staircase having a rectilinear or a helical development.

In order to allow a pair of adjacent elements to be joined together, each of the wings which are disposed aside of the step has a so-called "chair-like" conformation (see FIG. 1), which may be geometrically defined, in a side section, as a partial overlapping of a pair of rectangles, the respective bases of which are parallel to each other.

Thus, each wing element has a pair of recesses into which similar wing elements belonging to adjacent steps are respectively inserted.

Furthermore, the periphery of each wing is provided with several grooves, in which reinforcing rods are buried, said rods extending through the whole length of the staircase and acting as a supporting structure and as a holder for maintaining in a given position the structure which is formed by the joined steps.

The laying operation of a staircase having steps of the type mentioned above firstly begins by fixing to the floor the first step, in such a way as to form a base for the whole staircase.

Thereafter, the riser of the following step is placed upon the preceding step; each step is provided with a (generally wooden) falsework which is placed on the floor.

Once the whole staircase is assembled, with the exception of the last step, which acts as a footpace, suitable iron rods are inserted into the lateral grooves which are provided along the wings of each step; then, the last step is positioned and the iron rods are blocked into their seats, by means of anchoring them to the upper floor and of burying them in mortar of cement within said grooves.

The supporting falsework is then removed.

Both the monolithic step described above and the process for laying a staircase provided with such steps involve a plurality of disadvantages and drawbacks.

Concerning the process for laying the staircase, a major drawback is due to the fact of needing, for each single step, a supporting falsework or cribbing, whose height should be adapted to the step distance from the floor; this involves a great loss of time for laying the cribbing, remarkable costs for the cribbing itself and, finally, (and this fact particularly applies in the case of laying helical stairs), the area located under the staircase may not be accessible, owing to the presence of the struts which form the cribbing.

Finally, laying and burying a series of iron rods into the grooves involve further losses of time and work.

Concerning the monolithic step per se, the process for casting each step is extremely disadvantageous, both from the economical and from the productivity point of view.

In fact, casting such steps implies the use of special forms such as, for instance, the forms which are described in Italian patent no. 1.175.179, which have an extremely complicated structure constituted by several portions which are interconnected, for instance, by means of pivots, bolts and nuts and tension rods, said forms being provided with several surfaces for delimiting each step, said surfaces being disposed on planes which intersect at different angles.

These kinds of forms, which are normally used for casting steps of precast staircases are, owing to their complicated structure, very expensive and they have to be frequently replaced, thereby causing a strong increase of the staircase production costs.

Furthermore, the daily production of these kinds of step is rather limited since, prior to casting the concrete into the form, the latter should be provided in its interior with various metallic nets or grids for reinforcing, respectively, the wings and the tread of the step.

Finally, once the step is ready for receiving the casting of concrete, it should be placed in a vertical position, a wing being placed on the floor.

This arrangement provides for other disadvantages, since the opening for casting the concrete is rather small, and since the form may not be placed into a perfectly stable position.

The latter drawback is amplified in the case of casting of steps for helical staircases, whose forms, owing to casting reasons, should be placed with the smaller base placed on the working plan; thus, in order to avoid the form being overturned, it should be adequately supported from outside.

Document CH-A-531.628 discloses staircase forming metallic element comprising two parallel side flanges connected by two transversal walls which lay on planes at right angles relative to said flanges.

Said transversal walls, which respectively constitute the tread and the riser of the step, comprise respective male/female joints for the connection to other similar elements.

Such a staircase does not have any flexibility of use, owing to the stiffness of the connections between the different elements.

In particular, the dimensions of the tread and of the riser of the steps may not freely be modified.

Therefore, the staircase may only be used for connecting floors which are located at precisely predetermined distances from each other.

Furthermore, due to its metallic monolithic structure, the step is not suitable for being covered with high-quality materials such as wood, marble etc.; a staircase built according to the teachings of this Swiss document, thus, may only be seen as a low-cost emergency solution; it will never be used in valuable rooms or buildings.

Document FR-A-761.621 discloses a metallic staircase constituted by plate elements which are folded in order to form the steps of the staircase; said elements may be restrained into each other.

This solution also may not be freely used, and may not be employed for architectonically valuable uses.

Finally, document DE-B-1.042.868 discloses a self-supporting staircase which is constituted by a plurality of step modules and provided with supporting tension bars.

The present invention aims to obviate the disadvantages and drawbacks which are typical of the background art. The present invention provides a standardized step module which may be provided very easily and mass-produced, at a low production cost, and which would allows, when employed in conjunction with other identical modules, a staircase which can be assembled rapidly at a very low cost.

This is achieved by providing a standardized step module which comprises a tread element having predetermined dimensions, a riser element having a predetermined height, and a pair of opposed wing elements positioned aside of the tread and riser elements, wherein each of the wing elements comprises a metallic support structure which has a predetermined geometrical side shape. The metallic support structure is provided with a first base disposed at the same level as a base of the riser element and a second base is disposed at the same level as the tread element, such that the first and second bases are parallel to each other and are separated by a distance which is substantially equal to a height of the riser element. Further, each of the metallic support structures is provided with coupling means for allowing each of said modules to be coupled to an adjacent module.

Furthermore, the invention relates to a process for producing such a step, said process allowing great productivity and being easy to perform, thereby not requiring the forms to be laterally supported in order to maintain them in a stable position.

This is achieved by a process which comprises providing a form for producing the shape of the module which includes separating walls for defining the riser element, the tread element and the wing elements, placing the form on a horizontal work surface such that the tread element is substantially parallel to the work surface, and casting concrete in the form.

Further, the invention provides a prefabricated staircase, which is formed from a plurality of standardized self-supporting step modules, said staircase being able to be assembled rapidly and at a low cost and which would allow an operator to access the area underlying the staircase during the assemblying operations.

This is achieved by providing a prefabricated staircase comprising a plurality of the standardized step modules according to the present invention, wherein the modules are superimposed on lower adjacent modules and connected to adjacent modules with mechanical anchoring means and coupling means.

The invention has the further purpose of providing a rapid and inexpensive process for assemblying a prefabricated staircase.

This is obtained by anchoring a first module to a floor, superimposing a second module on top of the first module and fastening the first and second modules to each other with mechanical anchoring means, and sequentially positioning additional modules on underlying adjacent modules and fastening the additional modules thereto until a staircase having a predetermined length is formed.

The standardized step module according to the present invention is provided with a pair of wings disposed aside of the step and having the shape, as seen in a side section, of a parallelogram whose bases are parallel to the tread of the step and are separated by a distance equal to the riser of the step.

In the case of a step made of reinforced concrete, said wings are constituted by a metallic structure having said parallelogram shape and provided with suitable reinforcing members and buried in a casting of concrete.

According to the invention, the metallic structure forming the step wing is provided with suitable coupling means for joining it to other adjacent modules, said means being generally constituted by through-holes into which are inserted, for instance, fixing bolts and nuts.

The conformation of the structure forming a wing of the module according to the invention allows high production at a low cost of such reinforced concrete modules to be achieved.

In fact, the form for containing the concrete casting has an extremely simple shape and is, therefore, economically expedient, relative to the forms known in the art; furthermore, in order to cast the concrete, the form is simply put on the working plan in such a way as the tread of the step is parallel to said working plan, and the concrete may be cast over an extremely wide area, which comprises the entire tread of the step. This greatly simplifies the casting procedure owing to the fact that the module is simply put on the working plan, without needing any side support.

Additionally, the conformation of the module according to the invention enables a quick and comfortable assemblying of a staircase provided with such modules.

In fact, the assemblying operation merely involves laying the lower base of the wing of a step upon the upper base of the preceding step, then rigidly fastening together the two modules and repeating this procedure until the whole staircase is assembled.

Such an assemblying process allows a series of important advantages to be achieved in contrast to the prior art technique: in fact, during the assemblying operation, the staircase according to the invention needs only a single, central, supporting strut, instead of a whole cribbing or falsework underlying the staircase, thereby saving much time as well as material for the supporting falsework.

Furthermore, the staircase according to the invention does not require any laying operation of lateral reinforcing and supporting rods, nor a subsequent operation of burying said rods in a concrete casting: once the staircase according to the invention is assembled, it may immediately be trimmed, and this saves much time in contrast to the prior art technique.

According to a feature of the invention, each module comprises a metallic structure formed by two parallel, horizontal or vertical sides connected by two inclined sides, such structure being substantially parallelogram-shaped and further comprising a reinforcing element disposed between the vertices of said parallelogram.

According to the invention, the parallel horizontal or vertical sides are provided with coupling means which, in operation, cooperate with means for fastening a step, which step includes connecting means suitable for co-operating with said coupling means, said step being formed by a composite structure which may be made either of concrete/metal or only of metal, wood or other materials.

According to a preferred embodiment of the invention, the means for coupling pairs of adjacent and superimposed steps may also be used for fixing a series of accessories, such as for instance metallic uprights for supporting a breastwork or a bannister handrail.

Other features and advantages of the invention will become apparent from reading the following description of a preferred embodiment of the invention, given as a non-limiting example, with the help of the drawings shown in the attached sheets, in which.

Figure 1:
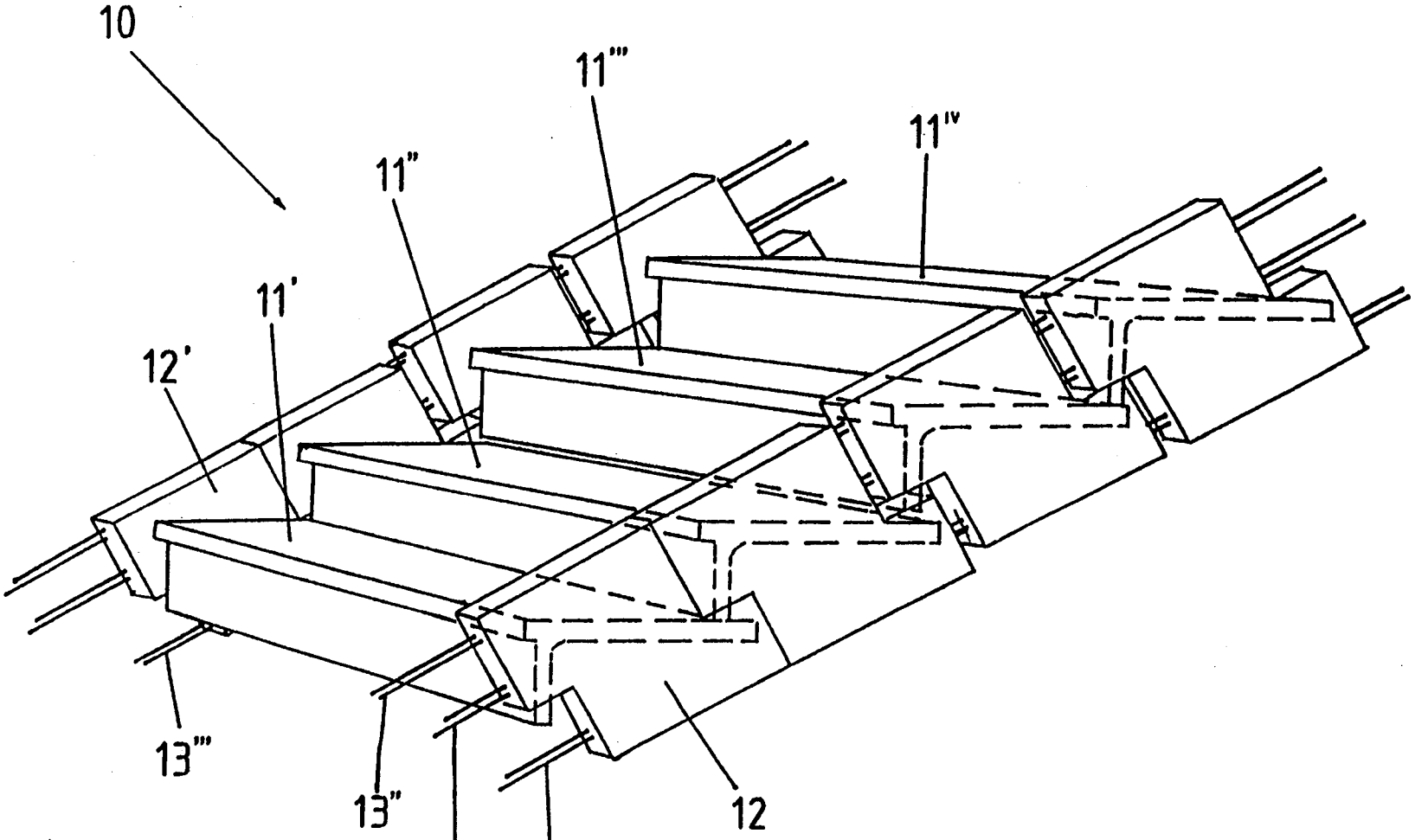
FIG. 1 shows a schematic perspective view of a type of staircase known in the art.

In FIG. 1, a precast staircase 10 in reinforced concrete, of a type known in the art, is constituted by a plurality of superimposed steps 11', 11'' . . . , each of said steps comprising a riser element, a tread element and a pair of wings 12, 12' which are respectively disposed at each side of the step.

As previously mentioned, each of the wings 12, 12' has a "chair-like" conformation, delimiting a pair of recesses suitable for receiving the extensions belonging to an adjacent wing.

Supporting and reinforcing iron rods 13, 13' . . . are inserted in suitable grooves and buried in a casting of concrete.

This known form of embodiment has the mentioned disadvantages, which are mainly relative to the production of the single steps, owing to the difficulty of providing for suitable forms, which always have a very complicated conformation and, therefore, a high cost.

Furthermore, it is not possible to provide for standardized connectors for fixing supporting uprights of a handrail; such uprights should necessarily be cemented in suitable holes which are bored on the step wings once the whole staircase is completely assembled, thereby causing further losses of time and work for providing said holes.

Figure 2:
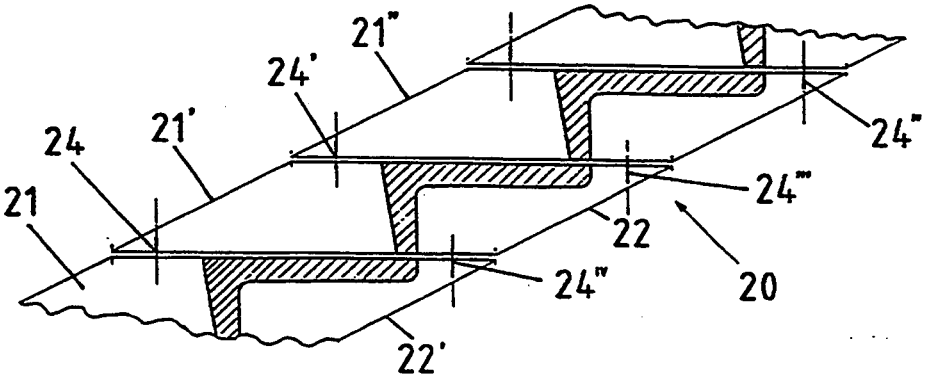
FIG. 2 shows a schematic side view of a staircase formed by standardized modules according to the invention.

FIG. 2 shows an advantageous form of embodiment of a staircase formed by standardized step modules 21, 21', 21'' according to the invention; the staircase which is shown is a precast staircase in reinforced concrete.

According to an essential feature of the invention, each module 21 comprises a pair of wings 22, 22' (see FIG. 3) formed by a metallic structure having a parallelogram shape whose bases are parallel to each other and are separated by a distance equal to the height of the step riser.

Said metallic structure is, in operation, buried in a casting of concrete.

According to another feature of the invention, each of the bases of the parallelogram-shaped metallic structure is provided with a pair of through-holes 24, 24' . . . , which are respectively disposed close to the edges formed by said bases with the inclined sides of the parallelogram.

Figure 4:
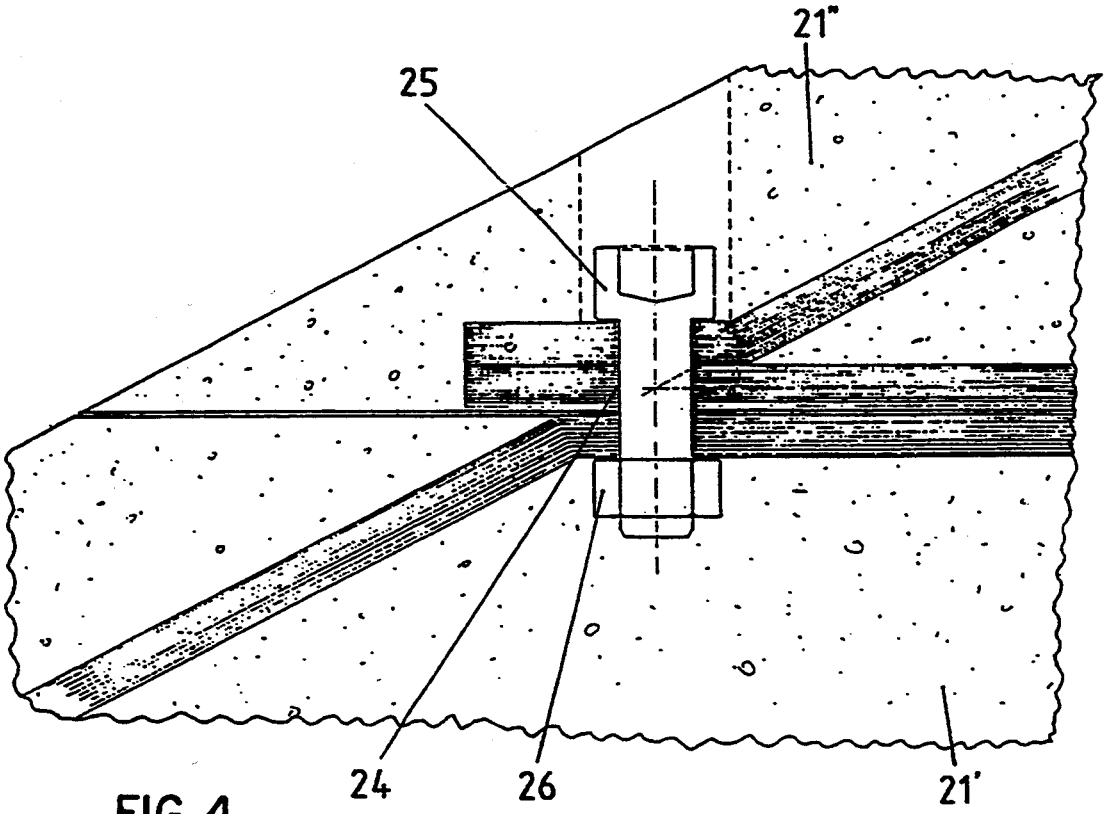
FIG. 4 shows an enlarged side section of an example of joint between a pair of standardized modules according to the invention.

As it may easily be noted in FIGS. 2 and 4, once the structure has to be buried in a casting of concrete, the holes 24 which are disposed in correspondence of areas which should be covered by the casting are in communication with the outside, thus enabling the passage of screw means 25.

Said screw means 25 normally cooperate with nuts 26 which are integral to the metallic structure of each module and they enable a comfortable fastening operation of each module upon an adjacent module.

A mass-production of standardized modules according to the invention is greatly simplified in comparison with the solutions known in the art.

In fact, each module is produced by simply providing a form reproducing the conformation of the parallelogram-shaped metallic structures (which may be provided with reinforcing bars) and of the actual step, putting said form on a working plan in a position where the step tread is parallel to the working plan, and finally carrying out the casting of concrete.

The assemblying operation of a staircase provided with such standardized modules is very convenient too: each module is placed upon the underlying module, taking care of aligning the respective holes 24 which are present on the bases of the metallica structures; thereafter, each module is screwed to the underlying module.

In this context, it should be noted that according to the form of embodiment shown in FIG. 2, the module 21'' is fastened to the module 21' by means of a screw which is inserted into hole 24' from above and of a screw which is inserted into hole 24''' from below.

This operating way may be rather inconvenient and dangerous for an operator who inserts the screws from below.

Thus, according to another form of embodiment, the hole 24''' provided in module 21'' is extended, by means of inserting a suitable metallic pipe prior to carrying out the casting, until it reaches the upper base of the module 21''.

In this way, a screw may be inserted into module 21'' from above and it may be fixed to the nut provided in correspondence of hole 24''' on module 21', thereby improving the ease and the safety conditions of the assemblying operations of the staircase.

Figure 3:
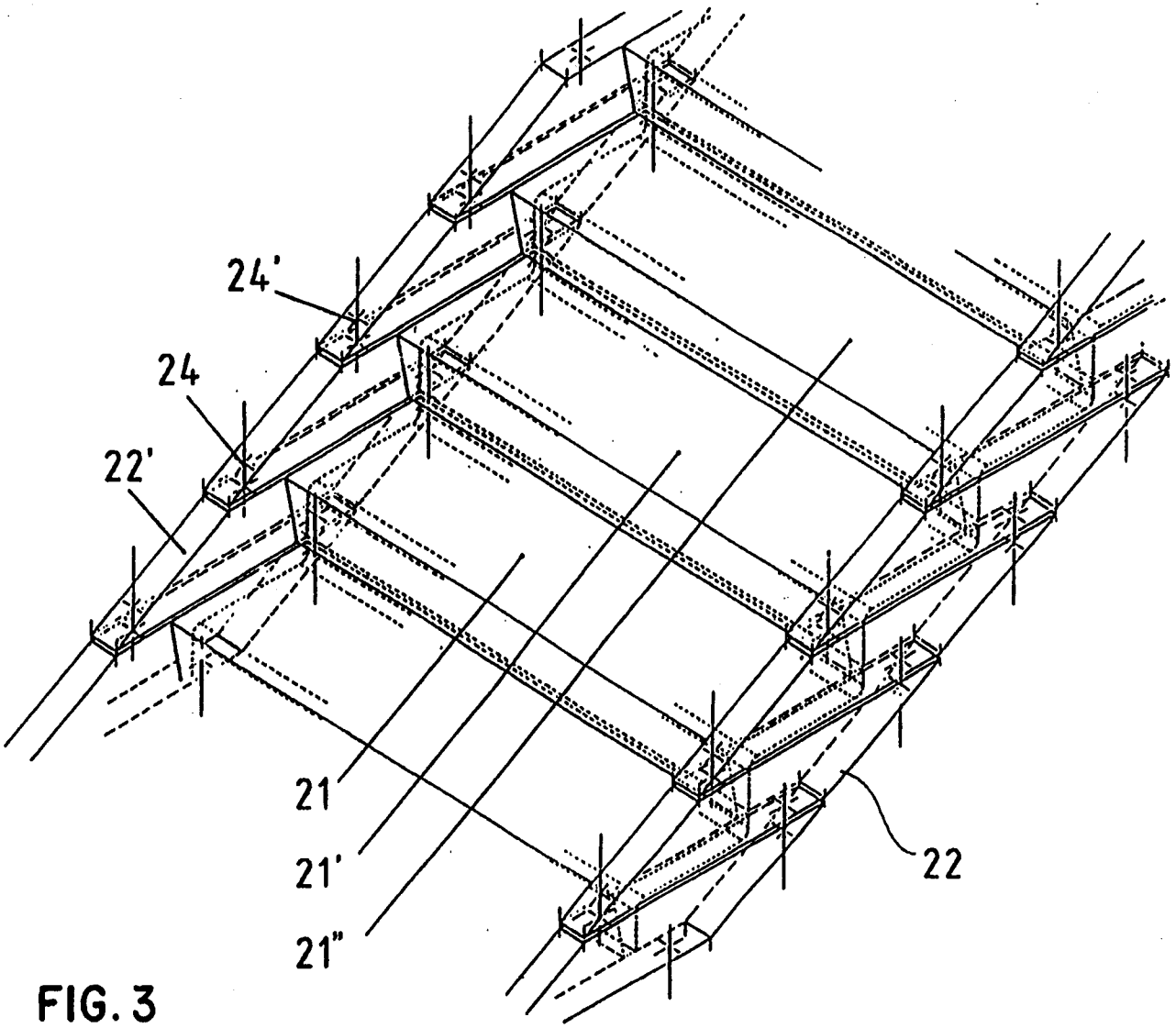
FIG. 3 shows a schematic perspective view of a staircase formed by standardized modules according to the invention.

As it may easily be noted in FIGS. 2 and 3, the assemblying operation is rapidly carried out in succession, just by screwing a module to the underlying one, and proceeding in this way until the upper floor is reached.

It should be remarked that, by means of this operation, the staircase is progressively fastened in a final way; according to the staircase length, only one or two intermediate supporting struts put on the floor are required, thereby practically eliminating the need (which is typical of the prior art) of a whole falsework for supporting each step until the upper floor is reached, and the need of providing lateral reinforcing rods.

As it may be noted in FIGS. 2 and 3, the height of the riser may easily be varied, according to project requirements, just by means of inserting, between pairs of adjacent modules, suitable spacing means such as, for instance, metallic washers which cooperate with the respective metallic structures and with the screw means.

According to a feature of the invention, the tread width is constant and is standardized, according to the standards in force, e.g. to 30 cm. This implies the fact that (see FIG. 3), the respective pair of holes 24, 24' is permanently disposed at a distance of 30 cm, if seen in a horizontal plan; this feature may be practically used for providing the staircase with connectors, which are disposed in correspondence of the holes 24, and which are suitable for cooperating with uprights (not shown in the figures) for supporting a breastwork and/or a bannister handrail.

Figure 5:
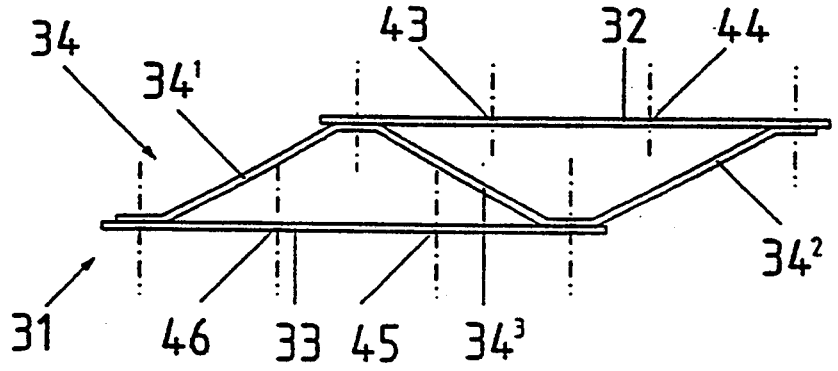
FIG. 5 shows a side view of a module of a supporting structure of a staircase according to another embodiment of the invention.
Figure 6:
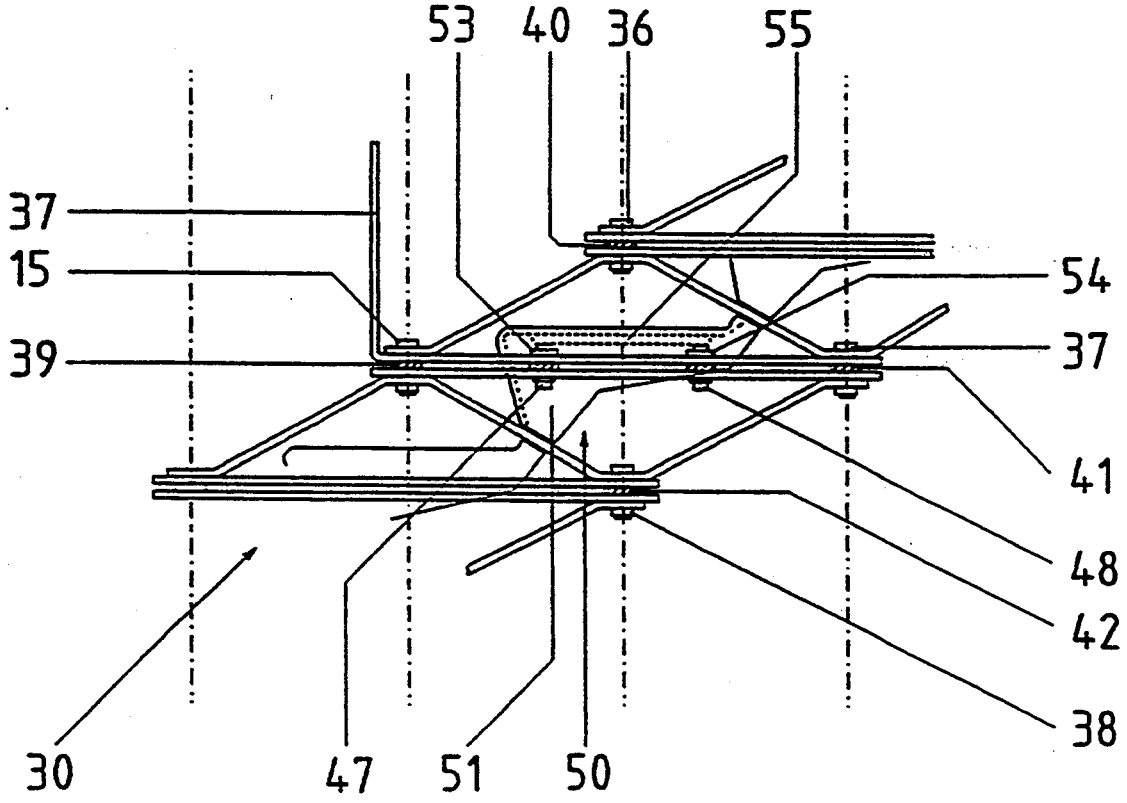
FIG. 6 shows a partial side view of a staircase comprising a plurality of modules according to FIG. 5.
Figure 7:
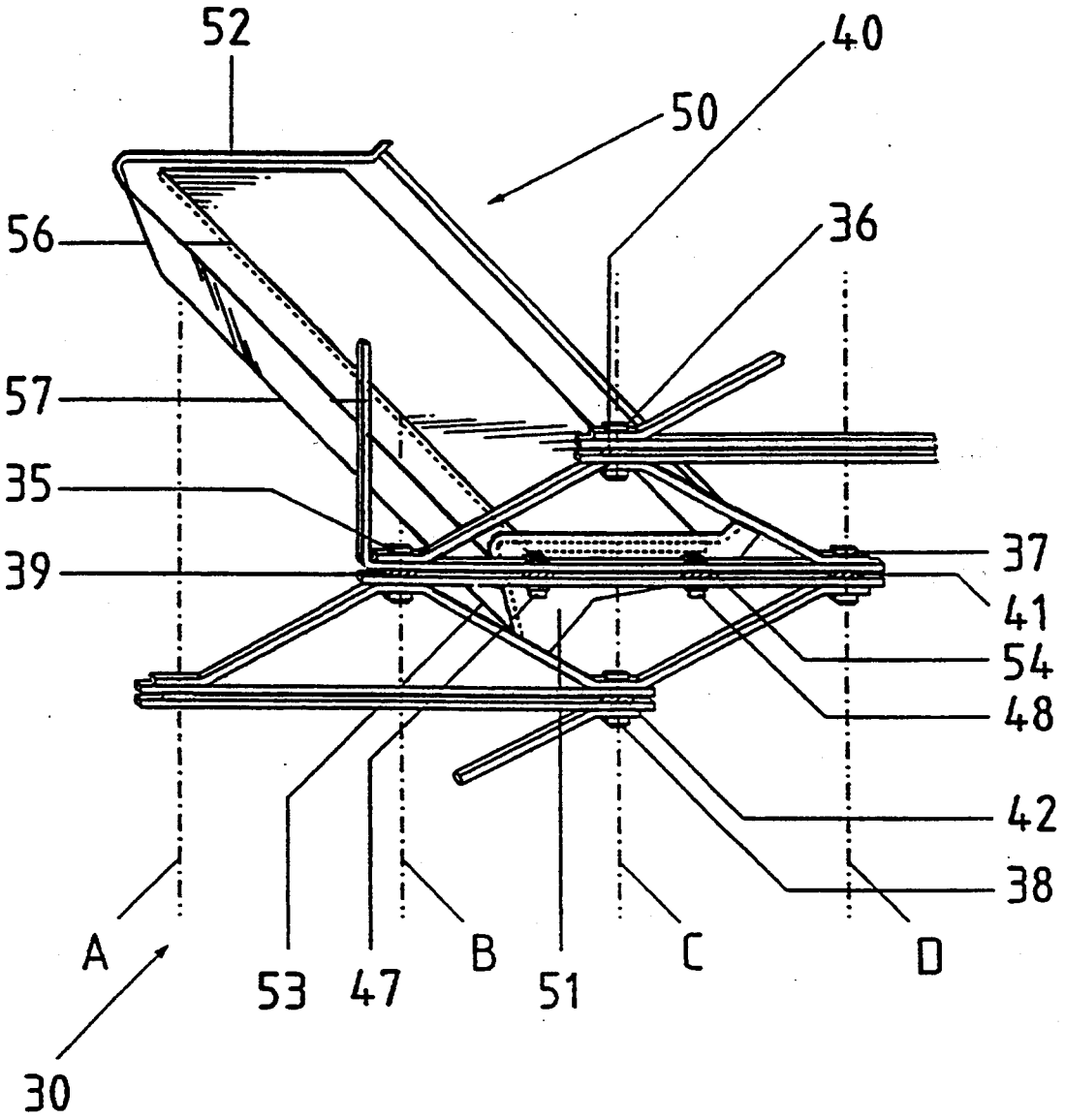
FIG. 7 shows a schematical perspective view of a staircase according to FIG. 6.

FIGS. 5 to 7 show a first variant of the staircase according to the invention.

Staircase 30 comprises at least one reticular supporting structure constituted by a plurality of modules 31 (see FIG. 5) superimposed to each other, each of these modules comprising a pair of horizontal bars 32, 33 which are connected by their ends to a double-bent bar 34.

The module according to this form of embodiment has the shape of a parallelogram, whose bases are constituted by horizontal bars 32, 33, while the inclined sides $34^1$, $34^2$ are constituted by the two end tracts of bar 34; the central tract $34^3$ of bar 34 forms in this case a reinforcing element for each module 31 of the structure. Alternatively, bars 32, 33 may be vertical.

The respective ends of said bars 32, 33, 34, as well as the two areas where bar 34 is bent in order to form the reinforcing element $34^3$, are provided with through-holes which enabling the passage of screw means 35, 36, 37, 38 (see FIGS. 6 and 7) suitable for rigidly coupling to each other the respective elements constituting each module 31 and pairs of adjacent modules.

Such a reticular supporting structure is characterised by a constant distance between the axes of the respective holes 36, 37, 38 and then, once the staircase is assembled, by constant tread widths.

On the other hand, in the vertical direction, each module 31 may be separated from an adjacent module by means of suitable washers 39, 40, 41, 42, by means of which different inclinations for the forming staircase flight, and thus step risers of different heights, may be achieved.

According to the invention, each horizontal bar 32, 33 of each module 31 is provided with a pair of through-holes 43, 44, 45, 46 located at regular intervals from the ends of said bar 32, 33, in such a way that respective hole pairs are aligned with each other when a module is placed upon another one.

Said through-holes 43–46 are suitable for enabling the passage of screw means for fastening a step having the following structure.

A step 30 is constituted, according to the form of embodiment shown in the figures, by a pair of metallic side elements 51, 52 which outline the shape, in side view, of the step itself; therefore, these elements comprise a riser and a tread.

According to this form of embodiment, each of the side elements 51, 52 is provided with a pair of brackets 53, 54 which are disposed at right angles relative to elements 51, 52 and which comprise through-holes enabling the passage of said screw means 47, 48.

A step of this kind is realised by means of the following procedure:

- a pair of metallic side elements 51, 52 is rigidly coupled by means of some (generally three) metallic bars which are welded between the walls of said side elements 51, 52;
- a wooden form, having a shape corresponding to that of elements 51, 52, is placed between said elements 51, 52;
- possible additional sections, e.g. a section for supporting an anti-skid device placed between the riser and the tread of the step, and/or a section outlining an intersection area for a plate (for instance a wooden, marble or granite plate) dignifying the step 50, and/or a section for supporting a rubber element placed at the end of the tread in order to facilitate cleaning of the step 50, are placed between said elements 51, 52;
- light concrete is cast inside of the form.

Once the casting is solidified, the step 50 is ready for being assembled on structure 31.

In fact, the bored brackets 53, 54 are simply placed in correspondence of the holes 43, 44 which are present on horizontal bars 32, 33 of structure 31 and the assembly is fastened by screw means 47, 48.

The staircase 30 according to the invention may be assembled by means of a very practical procedure.

In fact, since the trellis structure 31 forming the support for the steps 50 is self-supporting, the staircase 30 is built up according to the following procedure:

- the first structure element 31 is fastened to the floor, possibly by blocking it against a starting footpace;
- a second structure element 31 is placed upon the first one and it is immediately fastened to said first element by means of screw means, e.g. 35 and 37;
- similarly, further structure elements 31 are superimposed on the first ones until the upper floor is reached; the last elements may be placed on the upper floor in order to constitute a footpace; in the case of double-flight staircases, an intermediate footpace may be realised by means of suitably shaped structure elements.

According to this form of embodiment of the invention, the staircase 30 comprises a pair of supporting structures formed by elements 31, said structures being parallel to each other, the step being placed between them.

In order to facilitate assembly of the staircase supporting structure, suitable "working treads" (not illustrated in the figures) may be placed between the two supporting structures while elements 31 are being superimposed to each other.

Such "working treads" are simply constituted by rectangular shaped metallic elements which are fixed between the structures by using the holes 43–46 which are present for the ultimate fastening of the steps.

These "working treads" perform a first task of forming a spacer between the two supporting structures parallel to each other; furthermore, they allow the operators to climb the staircase during the assemblying operations of the latter, and thus to quickly reach the upper portions of the staircase itself.

Using these "working treads", therefore, implies the substantial advantage of firstly assemblying the whole staircase supporting structure, and then placing and fastening the steps 50.

In this way steps 50 may not be damaged during the assembly operations.

As it may be noted in FIGS. 6 and 7, a horizontal bar of a structure module 31 comprises a vertical prolongation 57.

This prolongation 57 is advantageously used for constituting an upright for supporting a breastwork and/or a bannister handrail and, since the staircase has a modular structure, a plurality of uprights may be disposed along the staircase, at regular and strictly equal intervals.

The staircase 30 described above is provided with a pair of modular supporting side structures.

However, the invention may also be carried out by means of a single supporting side structure, in the case where each step 50 is fastened by one side to said structure, wherein the other side is directly fastened to a wall.

Figure 8:
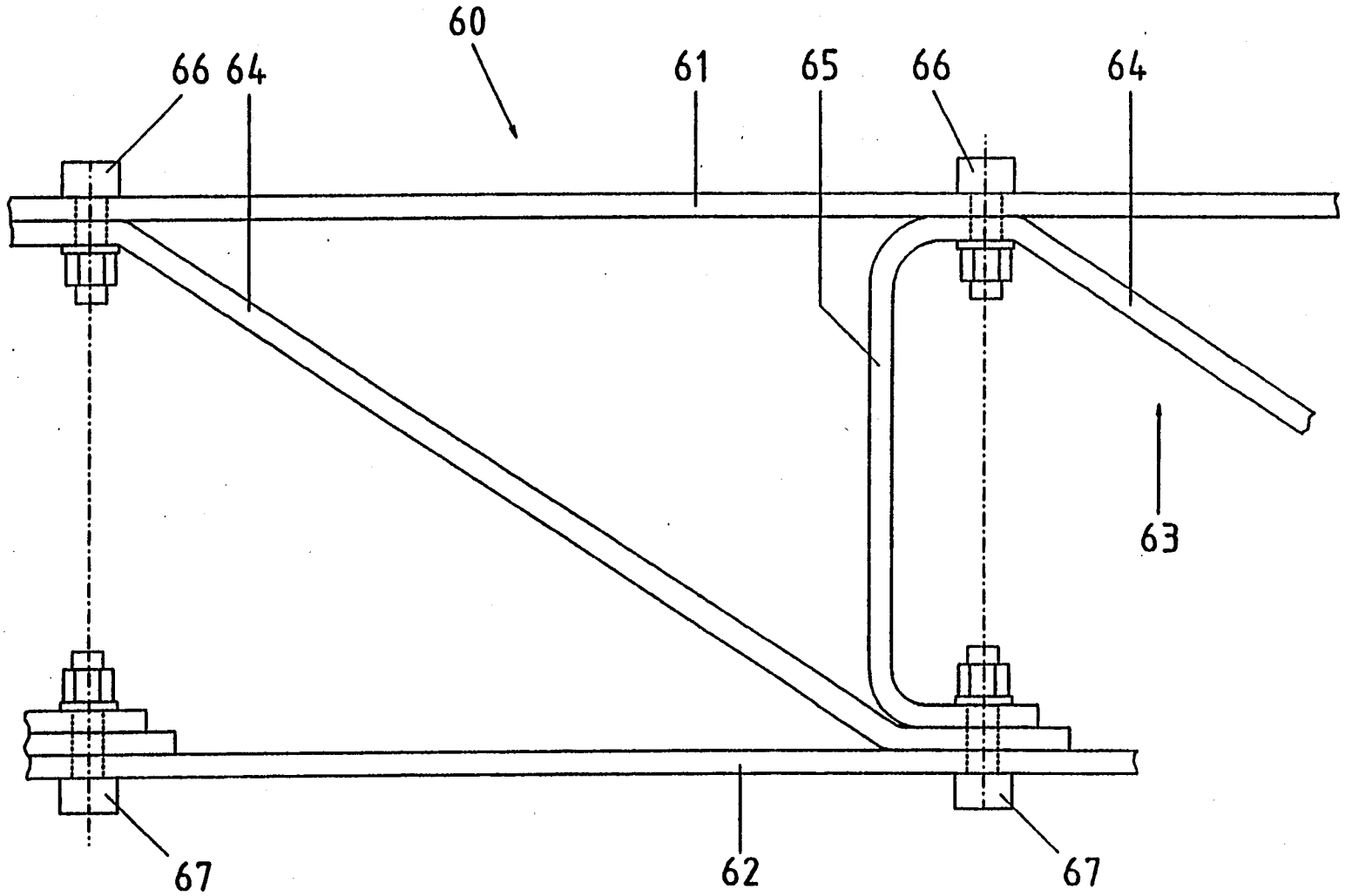
FIG. 8 shows a side view of a further embodiment of the invention.

FIG. 8 shows another form of embodiment of the invention.

In this case the lateral supporting structure 60 comprises a pair of rectilinear metallic bars 61, 62 parallel to each other.

Metallic reinforcing elements 63 are interposed between said bars 61, 62 at regular intervals, said reinforcing elements 63 including a first portion 64, suitable for supporting the :tread forming element of the step, and a second portion 65 which is generally disposed at right angles relative to said bars 61, 62.

Suitable screw means 66 realise the mechanical coupling between the respective bars 61, 62, 63.

The structure according to this form of embodiment features a more limited flexibility of use in respect of those structures which have been described with reference to FIGS. 1 to 7, since the tread and the riser of the step are, in this case, placed at strictly fixed and predetermined distances.

It is possible to modify the dimensions of these parameters by increasing the length of portion 65 of element 63, i.e. by increasing the distance between bars 61, 62.

In this case both the height of the riser and the width of the tread are simultaneously increased.

The solution illustrated in FIG. 8 is nonetheless relatively light, and avoids the need for large quantities of iron for the lateral supporting structures of the staircase.

The invention has been previously described with reference to some preferred forms of embodiment.

However, the invention comprises several further forms of embodiment which fall within its scope.

According to a first variant of the invention, the connections between the different modules of the supporting structure are carried out by welding rather than screwing means.

In this case the assembly procedure of the staircase is carried out in a workshop, and the supporting structure are delivered to the yard in an assembled fashion.

In the case where the steps are made of wood or of metal, said steps being constituted by a substantially rectangular plate, they may be directly fixed to the horizontal bars, without using any assemblying brackets or flanges, for instance by means of bolts and nuts cooperating with the holes which are present in the horizontal bars.

Still, in the case where the step is constituted by a composite metal/concrete structure, there is obviously no need of providing special flanges or brackets cooperating with the horizontal bars of the structure.

In fact, the lateral metallic elements 51, 52 may be provided with extensions allowing the step to be fixed by means of bolts and nuts or by welding to the inclined sides of the structure.

According to a further variant, which can be understood by reference to FIG. 5, each parallelogram-shaped module 31 is constituted by a first bar forming a horizontal side and by an inclined side (e.g. by a single bar which includes sides $34^1$ and 32 of the parallelogram), by a second bar forming another horizontal side and another inclined side (e.g. by a single bar which includes sides $34^2$ and 33 of the parallelogram), and by a third reinforcing bar which corresponds to tract $34^3$ of the bar 34 illustrated in FIG. 5.

According to a further variant (not illustrated in the figures), the parallelogram forming each module has a pair of vertical sides and a pair of inclined sides.

Referring to FIG. 7, this kind of structure may be realised by eliminating all the horizontal bars and by replacing them with vertical bars aligned with the respective axes A, B, C, D.

In this case the step 50 is provided with suitable means, e.g. with a bracket, for connecting it to a corresponding vertical bar.

According to another form of embodiment, at least one of the staircase supporting structures is assembled, in operation, on horizontal guides and is provided with means for anchoring it to said guides.

In the case where the staircase has to be placed adjacent to a wall, this configuration enables the supporting structure close to the wall (or the whole staircase) to be displaced in order to facilitate the finishing works, such as the wall plastering works.

In this case the staircase is delivered with "working treads" of a reduced length which are adaptable to the staircase having a reduced width when one of the supporting structures is brought near the other one.

The invention further comprises forms of embodiment according to which the staircase has a helical development.

According to this form of embodiment, the metallic structures forming the reinforcing elements of the wings are suitably pressed in order to obtain, when seen from above, the circular sector shape which is required for the project, while the substantially parallelogram shape of the side section of at least one of these structures remains unchanged.

These and other variants, within the range of mechanical equivalents, specifically referring to the means for fixing respective pairs of adjacent modules, fall within the scope of the invention.

We claim:

1. A self-supporting standardized step module for building prefabricated staircases which comprises:

a tread element having predetermined dimensions;

a riser element having a predetermined height; and a pair of opposed wing elements positioned aside of said tread and riser elements, wherein each of said wing elements comprises a metallic support structure which has a predetermined geometrical side shape, said metallic support structure provided with a first base disposed at the same level as a base of said riser element and a second base disposed at the same level as said tread element, said first and second bases parallel to each other and separated by a distance which is substantially equal to a height of said riser element, and wherein each of said metallic support structures have a parallelogram side shape and are provided with coupling means for allowing each of said modules to be coupled to an adjacent module.

2. The module according to claim 1, wherein said coupling means comprises through-holes in said metallic support structures for cooperating with screw means.

3. The module according to claim 1, wherein said coupling means are disposed on said first and second bases near edges formed by said bases with inclined sides of the parallelogram.

4. The module according to claim 1, wherein said riser element, tread element and wing elements are cast in a monolithic block of reinforced concrete.

5. The module according to claim 4, wherein said monolithic block is provided with openings for accessing said coupling means.

6. The module according to claim 1, which is formed entirely of metal.

7. The module according to claim 1, wherein said metallic support structures are provided with reinforcing elements disposed between said first and second bases.

8. The module according to claim 1, which is for building prefabricated rectilinear staircases, wherein the metallic support structures of each wing element of said pair of wing elements is identical.

9. A process for making the module of claim 1 comprising:

providing a form for producing the shape of said module, said form comprising separating walls for defining said riser element, said tread element and said wing elements;

placing said form on a horizontal work surface such that said tread element is substantially parallel to said work surface; and casting concrete in the form, wherein the metallic support structures forming the wing elements is contained in the casting.

10. A prefabricated staircase comprising a plurality of standardized step modules according to claim 1, further including mechanical anchoring means for anchoring modules superimposed on lower adjacent modules in conjunction with said coupling means, wherein the coupling means are located on the wing elements of the modules.

11. The prefabricated staircase according to claim 10, wherein said plurality of modules form a lateral support structure, said staircase further comprising a plurality of step elements which are individually fixed to said lateral support structure, each of said modules comprising:

two substantially horizontal or vertical side bars;

a first inclined side bar which rigidly couples a first end of one substantially horizontal side bar to a first end of the other substantially horizontal side bar, and a second inclined side bar which rigidly couples a second end of said first substantially horizontal side bar to a second end of the other substantially horizontal side bar, such that said two substantially horizontal side bars and said two inclined side bars define a parallelogram;

a reinforcing element interconnecting the first end of one of said substantially horizontal side bars to the second end of the other substantially horizontal side bar; and step coupling means for coupling a step element to the module; wherein said step elements comprise connecting means cooperating with said mechanical anchoring means and said step coupling means for rigidly connecting said step elements to said lateral support structure.

12. The prefabricated staircase according to claim 11, wherein said first and second inclined side bars and said reinforcing element are formed from a single bent metallic bar.

13. The prefabricated staircase according to claim 11, wherein one of said substantially horizontal side bars and said first inclined side bar are formed from a first bent metallic bar, the other substantially horizontal side bar and said second inclined side bar are formed from a second bent metallic bar, and said reinforcing element is formed from a third bar.

14. The prefabricated staircase according to claim 11, wherein said lateral support structure comprises:

a pair of parallel inclined bars which each have a length corresponding to a length of the staircase; and a reinforcing element comprising a first portion connecting said pair of inclined side bars, said first portion being substantially perpendicular to said inclined side bars, and a horizontal second portion for supporting a step element.

15. The prefabricated staircase according to claim 11, wherein said mechanical anchoring means comprises screws or welds.

16. The prefabricated staircase according to claim 11, wherein adjacent modules are connected through spacers.

17. The prefabricated staircase according to claim 11, which comprises two substantially horizontal bars, at least one of said substantially horizontal bars comprising a substantially vertical extension for supporting a breastwork or a bannister handrail.

18. The prefabricated staircase according to claim 11, wherein each of said step elements comprises at least one metallic side element integral with said connecting means and shaped to correspond to the shape of the side of the step element.

19. The prefabricated staircase according to claim 18, wherein said connecting means comprises metal flanges including holes for receiving screws therethrough.

20. The prefabricated staircase according to claim 18, wherein each step element comprises a pair of said metallic side elements which are connected to each other through metallic bars cast in concrete.

21. The prefabricated staircase according to claim 20, wherein a surface of each step element comprises at least one of an anti-skid material, a covering of marble, granite or wood, or a section made of resilient material which facilitates cleaning of the surface of the step element.

22. The prefabricated staircase according to claim 11, wherein said mechanical anchoring means comprises bolts and nuts and said coupling means comprises through-holes in said metallic support structure.

23. A process for assembling a staircase according to claim 1 comprising:

anchoring a first module to a floor;

superimposing a second module on top of said first module and fastening the first and second modules to each other with mechanical anchoring means; and sequentially positioning additional modules on an underlying adjacent module and fastening the additional modules to an adjacent module with mechanical anchoring means until a staircase having a predetermined length is formed.

24. The module according to claim 1, wherein said metallic support structures are provided with reinforcing elements located to correspond with said coupling means.

* * * * *